US005243160A

United States Patent [19]

Ohno et al.

[11] Patent Number: 5,243,160

[45] Date of Patent: Sep. 7, 1993

[54] OPERATING MECHANISM FOR AN INERT GAS FILLED CIRCUIT BREAKER

[75] Inventors: Masatomo Ohno, Hitachi; Tetsuo Fukuchi, Hitachiota; Akira Suzuki; Hiromichi Hokutou, both of Hitachi, all of Japan

[73] Assignee: Hitachi, Ltd., Tokyo, Japan

[21] Appl. No.: 721,814

[22] Filed: Jun. 26, 1991

[30] Foreign Application Priority Data

Jun. 26, 1990 [JP] Japan ..... 2-165575

[51] Int. Cl.[5] ..... H01H 33/42

[52] U.S. Cl. ..... 200/148 F

[58] Field of Search ..... 200/144 R, 144 AP, 148 R, 200/148 A, 148 B, 148 F

[56] References Cited

U.S. PATENT DOCUMENTS

| | | | |
|---|---|---|---|
| 2,853,584 | 9/1958 | Upton, Jr. | 200/149 R |
| 3,824,361 | 7/1974 | Noack et al. | 200/148 F |
| 3,876,846 | 4/1975 | Graybill | 200/148 B |
| 4,054,765 | 10/1977 | Peek et al. | 200/148 F |
| 4,365,126 | 12/1982 | Oshima et al. | 200/144 AP |
| 4,417,111 | 11/1983 | Kishi et al. | 200/148 R |
| 4,612,428 | 9/1986 | Nicoloso | 200/148 R |
| 4,654,494 | 3/1987 | Wuthrich | 200/337 |
| 4,983,792 | 1/1991 | Rogers et al. | 200/148 F |

FOREIGN PATENT DOCUMENTS

| | | |
|---|---|---|
| 25713/71 | 2/1971 | Australia . |
| 37326/71 | 12/1971 | Australia . |
| 12632/76 | 1/1980 | Australia . |
| 15758/76 | 2/1980 | Australia . |
| 52064/79 | 1/1983 | Australia . |
| 1485270 | 7/1966 | France . |
| 2122550 | 1/1972 | France . |
| 52-156973 | 11/1977 | Japan . |
| 61-284014 | 12/1986 | Japan . |
| 574162 | 11/1974 | Switzerland . |

*Primary Examiner*—J. R. Scott

*Attorney, Agent, or Firm*—Antonelli, Terry, Stout & Kraus

[57] ABSTRACT

A gas-filled circuit breaker includes a hermetically sealed tank formed by a surrounding wall filled with an insulating gas, at least one pair of contacts which are arranged in the inside of the surrounding wall, and a contact operating device for connecting the contacts to each other for conducting electricity therebetween and separating the contacts from each other for interrupting the electricity therebetween. The contact operating device includes a force generating device for generating a force for operating the contacts, and the contact operating device is arranged outside of the surrounding wall. A rotational shaft device is connected to the force generating device outside of the surrounding wall and extends from the outside of the surrounding wall to the inside thereof so that the force generated by the force generating device is transmitted through the surrounding wall to the inside thereof. A seal device is arranged between the surrounding wall and the rotational shaft device to maintain a hermetic seal therebetween, and at least two bearings rotatably support the rotational shaft device; and a connecting device for transmitting the force from the rotational shaft device to at least one of the contacts is moved in relation to another one of the contacts, wherein the connecting device is connected to the rotational shaft device between the bearings.

6 Claims, 7 Drawing Sheets

OPERATING MECHANISM FOR AN INERT GAS FILLED CIRCUIT BREAKER

BACKGROUND OF THE INVENTION AND RELATED ART STATEMENT

The present invention relates to a gas-filled circuit breaker, particularly to a gas-filled circuit breaker having a driving force for operating contacts being supplied from the outside of the breaker.

Generally, a gas-filled circuit breaker has a pair of contacts in a hermetically sealed container filled with an arc-extinguishing gas, and an operating device for driving the pair of contacts to be closed and opened is arranged at the outside of the hermetically sealed container. Therefore, a driving force transmission mechanism between the operating device and one of the movable contacts includes a hermetically sealed connecting mechanism for transmitting the driving force with maintaining the hermetic seal of the container.

The conventional hermetically sealed connecting mechanisms such as those shown in FIGS. 5*a*, 5*b* and 10 include a rotational seal structure or a linear seal structure. Typical conventional seal structures are illustrated at 71, 72 in FIGS. 5*b* and 10. The rotational seal as shown in FIG. 5*a* is disclosed by Publication of Laid-open Japanese Patent Application 61-284014. In FIG. 5*a*, a hermetically sealed container 1 with an end plate 1*b* is filled with the arc-extinguishing gas and receives an interrupter portion 12 including a pair of contacts. A movable part of the interrupter portion 12 is connected through an insulated operating rod 15 to an interior lever 16 fixed to a rotational shaft 2. The rotational shaft 2 extends through a side wall of a case 17 fixed to the end plate 1*b* with a hermetic seal between the shaft 2 and the side wall, and has an exterior lever 4 at the outside of the case 17. The exterior lever 4 is connected to a driving shaft 18 of an operating device 13 with a dashpot device 10 and a closing spring 11. When the interrupter portion 12 is operated by the operating device 13 to be opened or closed, the rotational shaft 2 is rotated while keeping the hermetic seal of the case 17 and of the hermetically sealed container 1 sealed with a gasket or the like.

In the conventional gas-filled circuit breaker including the linear seal structure as disclosed by Publication of Laid-open Japanese Utility Model Application 52-156973, the driving rod 18 is coaxially connected to the insulated operating rod 15, and extends through a wall surface of the case 17 while keeping the hermetic seal between the driving rod 18 and the case 17.

OBJECT AND SUMMARY OF THE INVENTION

The object of the present invention is to provide a gas-filled circuit breaker in which only a small number of bearings are used, but the reliability of the bearings is high.

According to the present invention, a gas-filled circuit breaker comprises, a hermetically sealed tank formed by a surrounding wall filled with an insulating gas, at least one pair of contacts which are arranged in the inside of the surrounding wall and which are capable of being connected to each other for flowing electricity therebetween and of being separated from each other for interrupting the electricity therebetween, and contact operating means for connecting the contacts to each other and separating the contacts from each other, the contact operating means including force generating means which generate a force for operating the contacts and are arranged at the outside of the surrounding wall, rotational shaft means which are connected to the force generating means at the outside of the surrounding wall and extend from the outside of the surrounding wall to the inside thereof so that the force generated by the force generating means is transmitted through the surrounding wall to the inside thereof, seal means arranged between the surrounding wall and the rotational shaft means to keep a hermetic seal therebetween, at least two bearings for supporting the rotational shaft means in a rotatable manner, and connecting means for transmitting the force from the rotational shaft means to at least one of the contacts to be moved in relation to another one of the contacts, wherein the connecting means are connected to the rotational shaft means between the bearings.

In the gas-filled circuit breaker according to the present invention, since the connecting means are connected to the rotational shaft means between the bearings, each of radial loads of the bearings supporting a radial force applied from the one of the contacts moved through the connecting means to the rotational shaft means is smaller than the radial force applied from the moved one of the contacts. Therefore, a reliability of the bearings is improved and a size of the bearings may be small, though the minimum number of the bearings is used.

DETAILED DESCRIPTION OF PREFERRED EMBODIMENTS

Figure 1A:
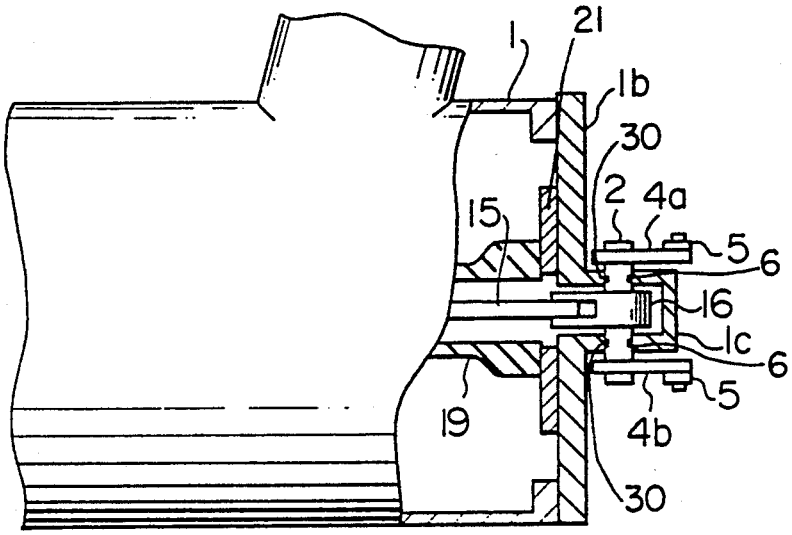
FIG. 1*a* is a partially cross-sectional view showing an embodiment of a gas-filled circuit breaker according to one embodiment present invention.
Figure 2:
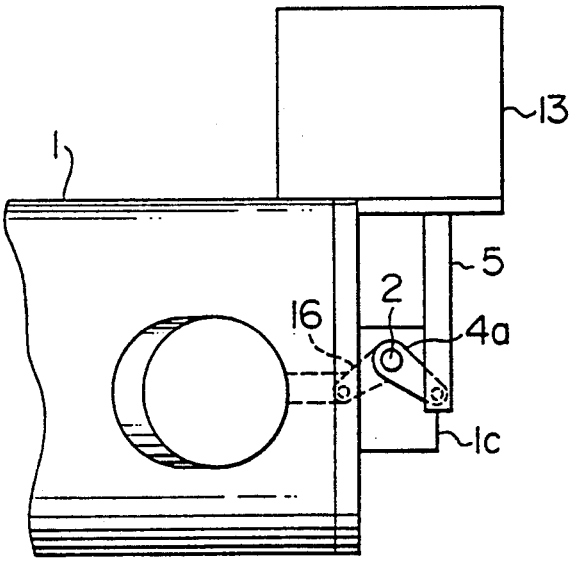
FIG. 2 is a plan view showing a part of the embodiment of FIG. 1*a*.
Figures 1B, 1C:
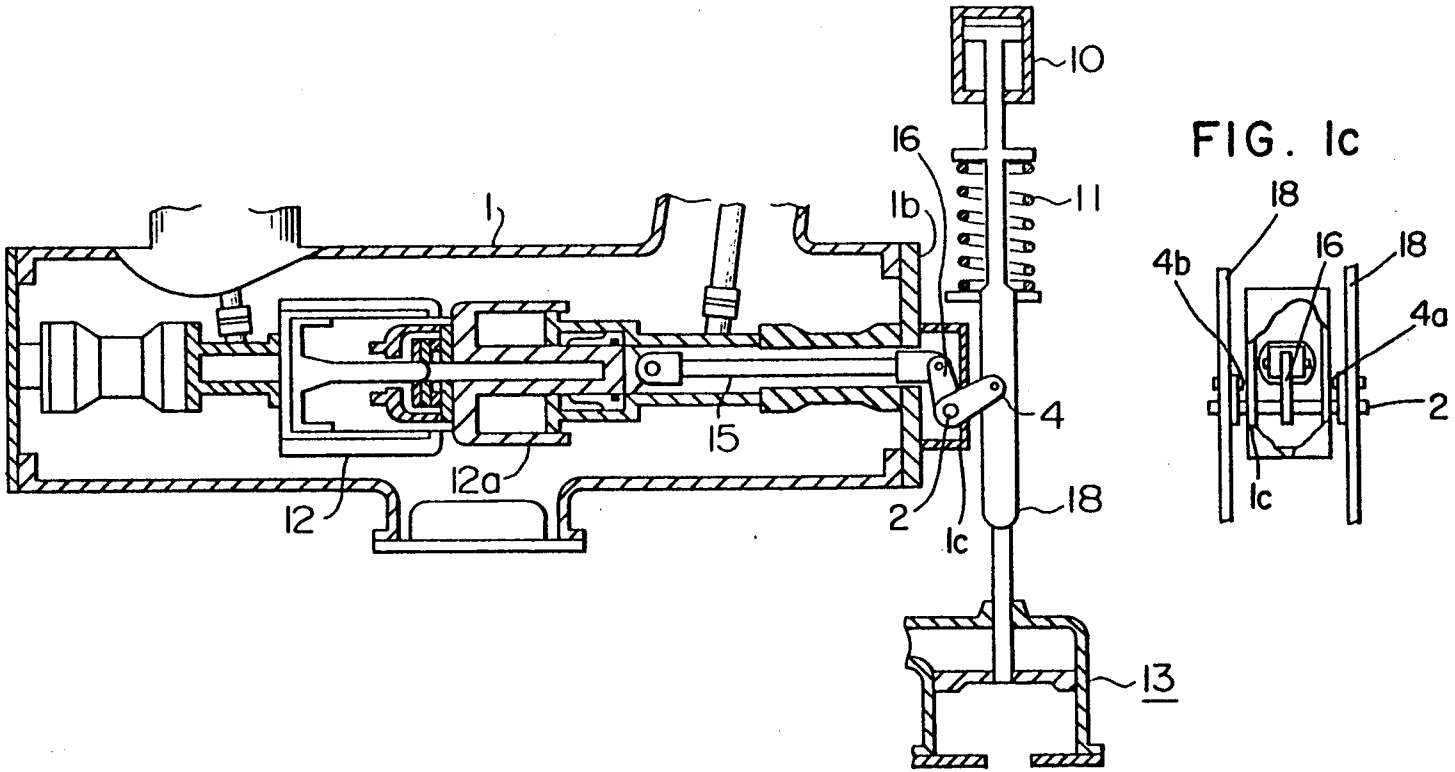
FIG. 1*b* is a cross-sectional view showing an embodiment of a gas-filled circuit breaker according to the present invention.
FIG. 1*c* is a partial cross-sectional view showing a structure viewed from a direction indicated by an arrow 1*c* in FIG. 1*b*.
Figure 5A:
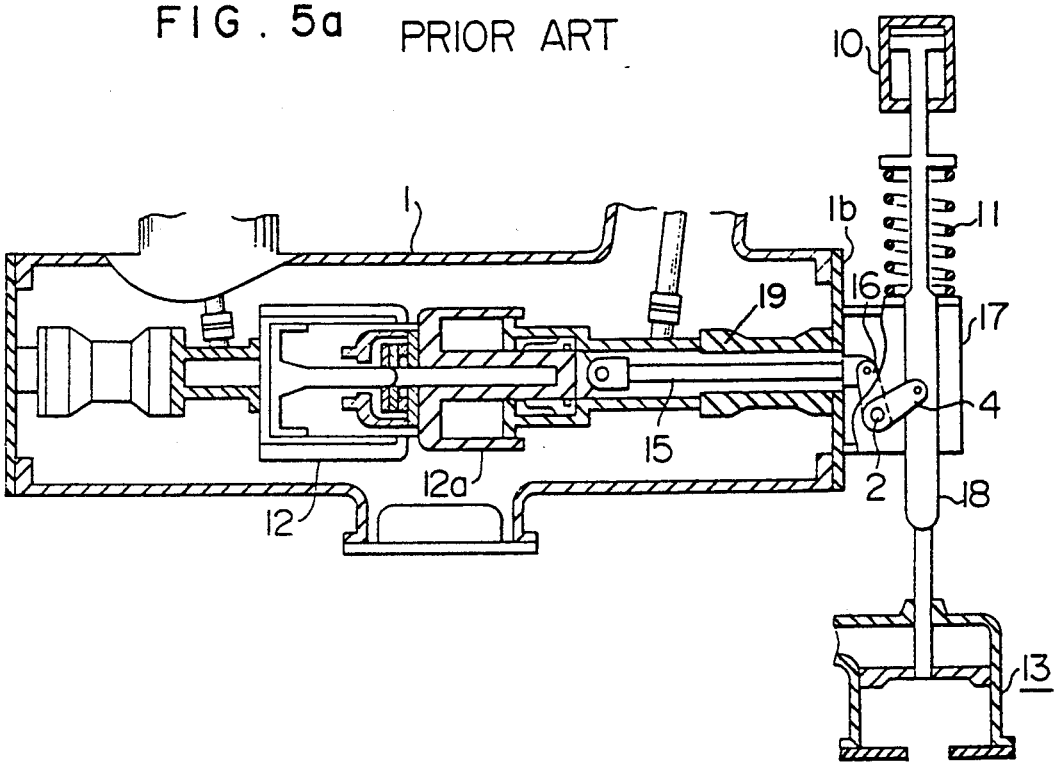
FIG. 5a PRIOR ART
FIG. 5*a* is a cross-sectional view showing a conventional gas-filled circuit breaker.
Figure 5B:
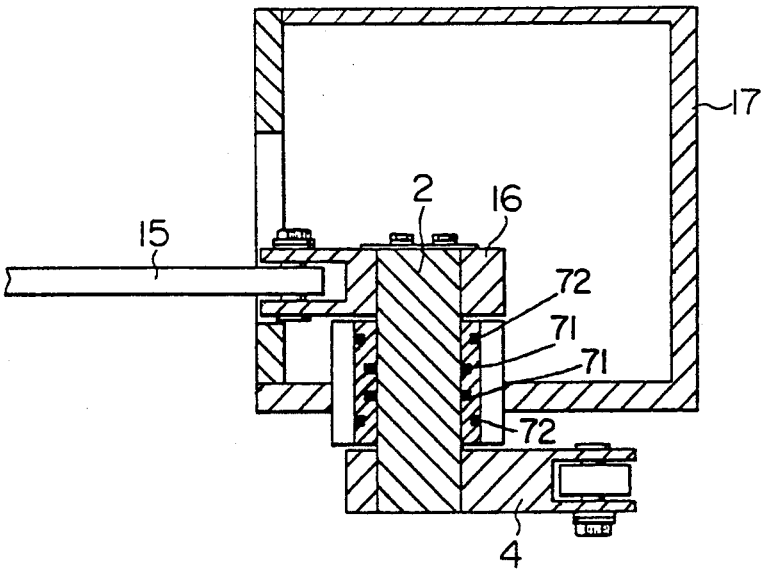
FIG. 5b PRIOR ART
FIG. 5*b* is a partially cross-sectional view showing a part of a conventional gas-filled circuit breaker.

As shown in FIGS. 1*a*, 1*b*, 2, and 3, a hermetically sealed container 1 with an end plate 1*b* is filled with an arc-extinguishing-and-insulating gas and receives an interruptor device as shown in FIG. 5. A movable part of the interruptor device is supported movably by an insulating tube 19 and is connected to a left end of an insulated operating rod 15. A case 1c projects outwardly from the end plate 1b of the hermetically sealed container 1 and has a pair of wall surfaces opposite to each other as shown in FIG. 1a. A rotational shaft 2 extends through the pair of wall surfaces, and hermetic seals in a rotatable manner are formed by gaskets or the like between the rotational shaft 2 and the case 1c. The rotational shaft 2 is fixed to a pair of exterior levers 4a and 4b at the outside of the hermetically sealed container 1 and is fixed to an interior lever 16 at the inside of the case 1c. The exterior levers 4a and 4b are connected to output shafts 5 of an operating device 13 respectively. The interior lever 16 is arranged at a longitudinally central portion of the rotational shaft 2, and distances between the exterior levers 4a, 4b and the longitudinally central portion of the rotational shaft 2 are equal to each other. Gaskets 6 are arranged between the rotational shaft 2 and the wall surfaces of the case 1c, and a pin 20 connects the interior lever 16 to the insulated operating rod 15. As illustrated in FIG. 1a, the insulated operating rod 15 is mounted on an end plate 1b through a spacer 21.

An operating force of the operating device 13 is transmitted to the rotational shaft 2 by the output shafts 5 through the exterior levers 4a, 4b mounted on respective longitudinal ends of the rotational shaft 2 so that the rotational shaft 2 is rotated to drive the movable part of the interruptor device through the interior lever 16 and the insulated operating rod 15. Since the interior lever 16 is connected to the rotational shaft 2 between bearings 30, each of radial loads of the bearings 30 supporting a radial force applied from the movable part of the interruptor device through the interior lever 16 and the insulated operating rod 15 to the rotational shaft 2 is smaller than the radial force applied from the movable part of the interruptor device through the interior lever 16 and the insulated operating rod 15 to the rotational shaft. Therefore, the reliability of the bearings 30 is improved and the size of the bearings 30 may be small though a minimum number of bearings 30 are used. And, the thickness of the wall of the case 1c, and a diameter of the rotational shaft 2 may be small in size in comparison with the prior art where the rotational shaft extends through only a single wall of the case as in the prior art of FIGS. 5a, 5b and 10.

As shown in FIG. 3 and FIGS. 7-9, the case 1c has a part of the surrounding wall of the hermetically sealed tank as bearings 31 for rotatable supporting the rotational shaft 2 adjacent to the longitudinal ends of the rotational shaft 2 between the exterior levers 4a and 4b, which are driven from outside of the case 1c by the operating device 13, thus the case 1 itself forms the bearings 30 for rotatably supporting the rotational shaft 2 at each of longitudinal ends of the rotational shaft 2 between the exterior levers 4a and 4b driven by the operating device 13.

Figure 3:
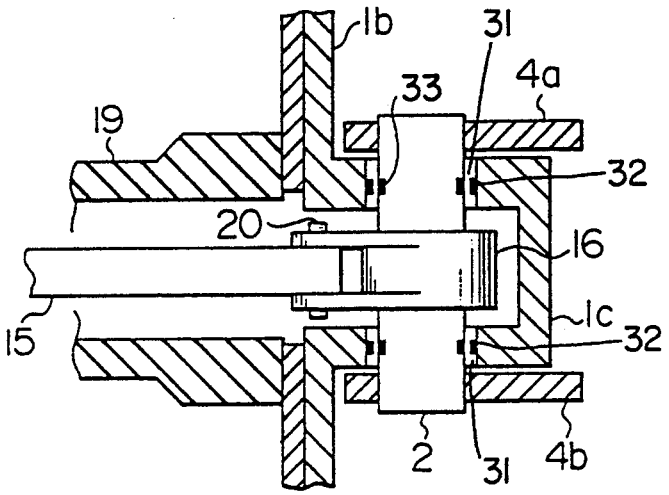
FIG. 3 is a detailed cross-sectional view showing a part of the embodiment of FIG. 1*a*.

As shown in FIG. 3, gaskets 33 received in respective annular grooves formed on the rotational shaft 2 are arranged between the rotational shaft 2 being the rotational shaft means and the bearings 31 received by the case 1c to keep the hermetic seal therebetween.

As shown in FIG. 3, gaskets 32 are formed in respective annular grooves formed on the bearings 31, and the gaskets 32 are arranged between the case 1c and the bearings 31 to maintain the hermetic seal therebetween.

Figure 4:
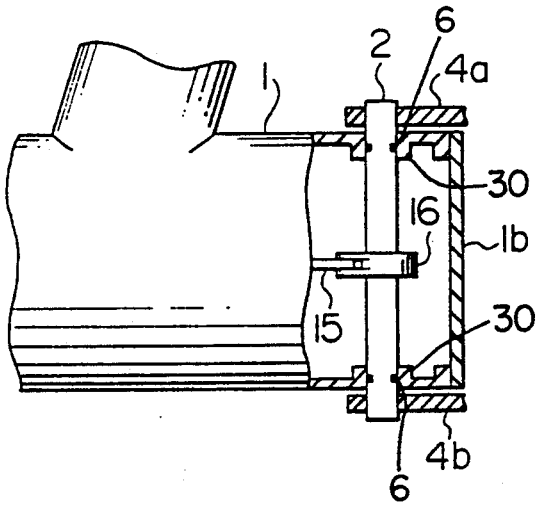
FIG. 4 is a partially cross-sectional view showing a part of another embodiment of a gas-filled circuit breaker according to the present invention.

As shown in FIG. 4, the case 1 itself forms the bearings 30 for rotatably supporting the rotational shaft 2 adjacent to longitudinal ends of the rotational shaft 2 between the exterior levers 4a and 4b which are driven at the outside of the case 1 by the operating device 13.

As shown in FIG. 4, gaskets 6 are formed in respective annular grooves formed on the rotational shaft 2 and are arranged between the rotational shaft 2 being the rotational shaft means and the bearings 30 formed directly on the case 1 as the surrounding wall of the hermetically sealed tank to maintain the hermetic seal therebetween.

In FIG. 4, the rotational shaft 2 is supported on walls opposite to each other in the hermetically sealed container 1c without the case 1. The longitudinal ends of the rotational shaft 2 are rotatably supported on the walls of the hermetically sealed container 1 with the gaskets therebetween and extend to the outside of the hermetically sealed container 1 to be fixed to the exterior levers 4a, 4b connected to the output shaft of the operating device. The rotational shaft 2 is fixed to the interior lever 16 connected to the movable part of the interruptor device at the inside of the hermetically sealed container 1. Since the rotational shaft 2 is driven through both of the longitudinal ends thereof, the diameter of the rotational shaft 2 may be small. As described above, it is important for the rotational shaft 2 to support the interior lever 16 between the bearings 30 on the walls opposite to each other.

Figure 6:
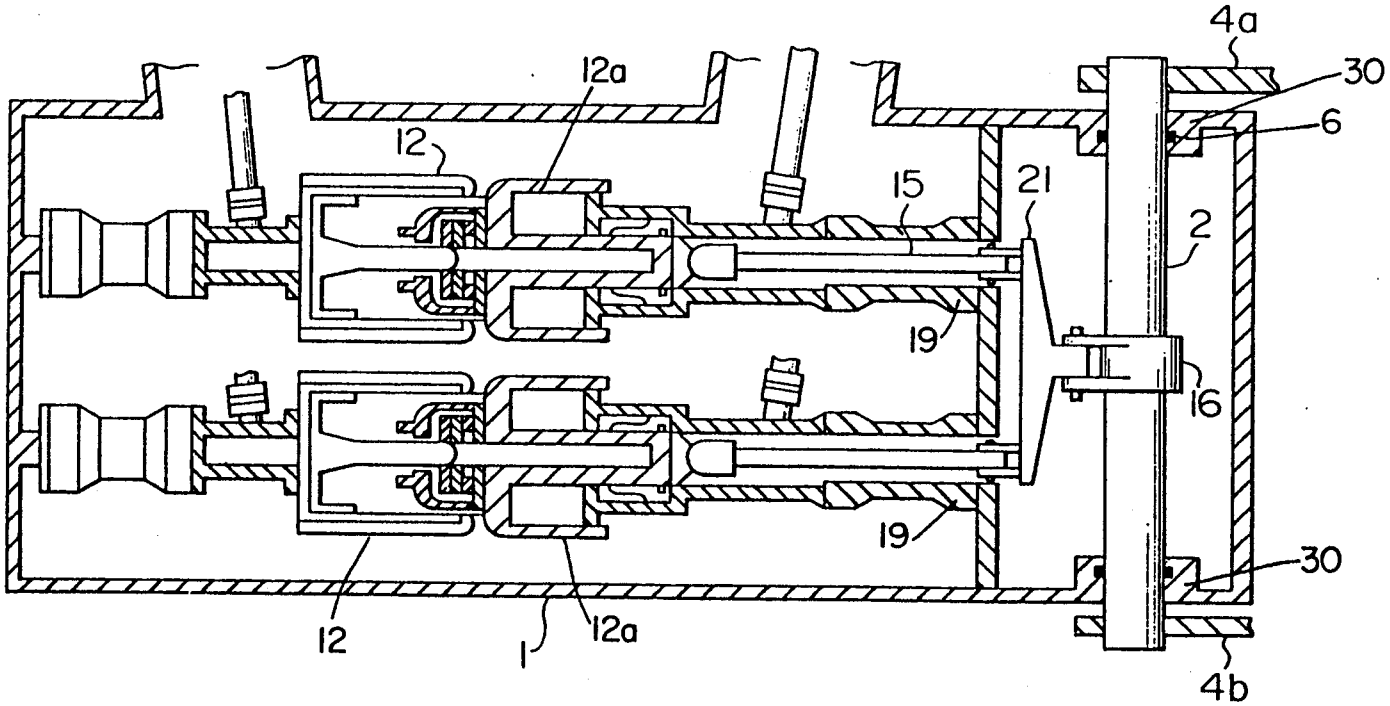
FIG. 6 is a partially cross-sectional view showing another embodiment of a gas-filled circuit breaker according to the present invention.

In FIG. 6, the hermetically sealed container 1 receives the interruptor portion 12 including three pairs of contacts (only two of which are shown in the drawing) for a three-phase circuit. The interruptor portion 12 may be a puffer-type. Right ends of the insulated operating rods 15 for the three pairs of contacts are connected to a common support body 21 through pins. The support body 21 is connected through pins to the rotational shaft 2 at the inside of the hermetically sealed container 1. The rotational shaft 2 is supported in a manner shown in FIG. 4, or alternatively in a manner as shown in FIG. 1. Since the rotational shaft 2 supports the interior lever 16 between the bearings 30 to drive the movable parts of the three pairs of contacts and is driven through both of the longitudinal ends thereof, a diameter of the rotational shaft 2 may be small.

Figure 10:
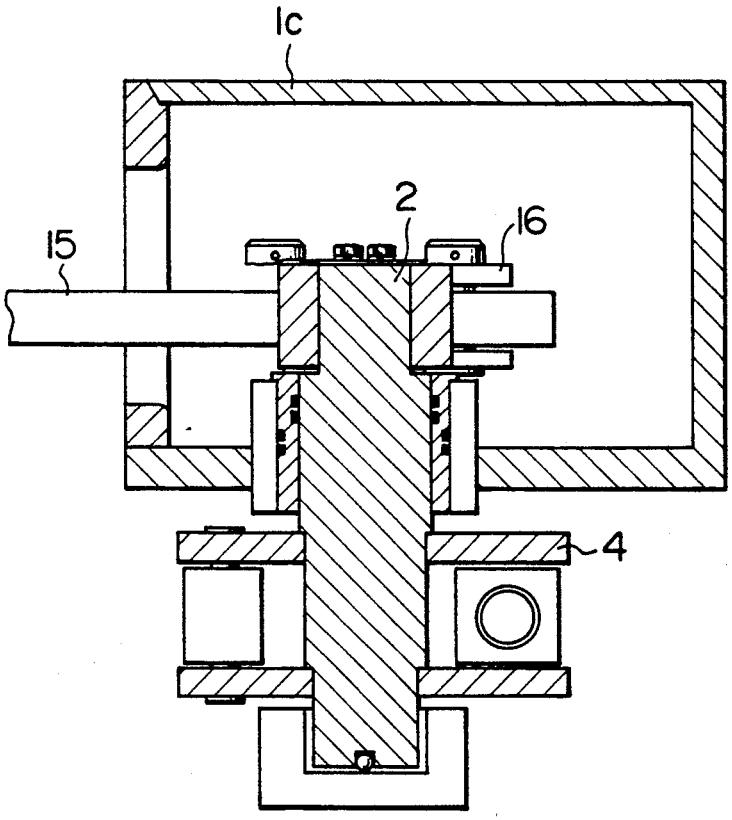
FIG. 10 PRIOR ART
FIG. 10 is a partially cross-sectional view showing a part of a conventional gas-filled circuit breaker.

As illustrated in FIGS. 6 and 10, the movable contact 12a and stationary contact 12 form an interrupter portion which may be a puffer-type. The movable contact 12a driven through the rod 15, the lever 16 and the shaft 2 by the operating device 13. The contact 12a is moved to contact the stationary contact 12 to conduct an electric current therebetween, and is separated from the stationary contact 12 to prevent the electric current flow therebetween.

The present invention may be applied to a gas-filled circuit breaker including a plurality of the hermetically sealed containers 1 each of which receives the pair of contacts and in which a common operating device drives the pairs of contacts to close or open. The output shaft 5 extends among the hermetically sealed containers 1 so that the all of the exterior levers 4a, 4b are driven by the output shaft 5. The distances between the exterior levers 4a, 4b, and the longitudinally central portion of the rotational shaft 2 may be different from each other and the interior lever 16 may be arranged at a position different from the longitudinally central portion of the rotational shaft 2 in the hermetically sealed containers 1.

Figure 7:
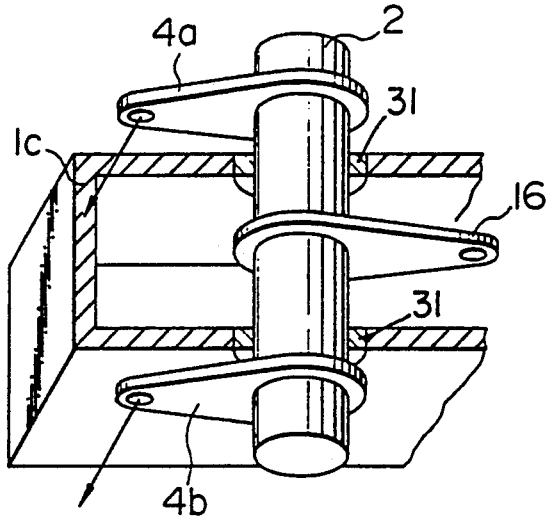
FIGS. 7 to 9 are partially cross-sectional views showing modifications of contact operating mechanisms of a gas-filled circuit breaker according to the present invention.
Figure 8:
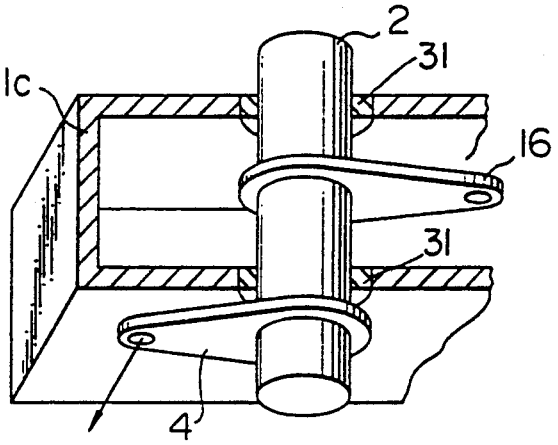
Figure 9:
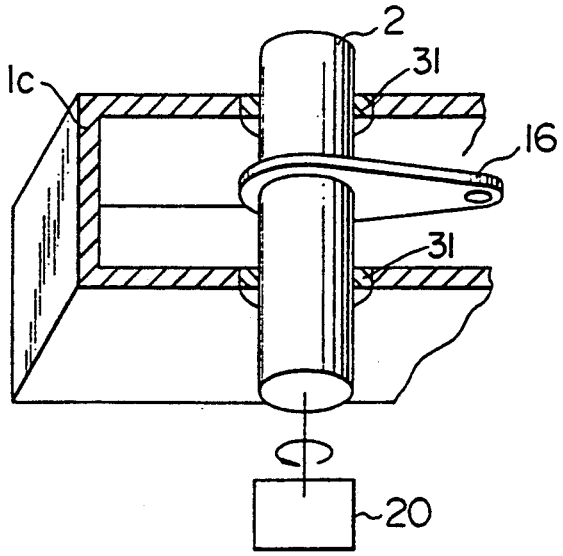

As shown in FIGS. 7 to 9, the exterior lever 4 may be fixed to only one of the longitudinal ends of the rotational shaft 2', the exterior levers 4 may be fixed to the longitudinal ends of the rotational shaft 2 respectively, and one of the longitudinal ends of the rotational shaft 2 is connected to a motor or a fluid pressure rotary actuator to be rotated directly.

What is claimed is:

1. A gas-filled circuit breaker comprising, a hermetically sealed tank formed by a surrounding wall filled with an insulating gas;

at least one pair of contacts arranged in an inside of the surrounding wall;

contacts operating means for connecting contacts to each other for conducting electricity therebetween and separating the contacts from each other for interrupting the electricity therebetween, the contact operating means including force generating means for generating a force for operating the contacts and are arranged at an outside of the surrounding wall;

rotational shaft means connected to the force generating means at the outside of the surrounding wall and extend from the outside of the surrounding wall to the inside thereof so that the force generated by the force generating means is transmitted through the surrounding wall to the inside thereof;

seal means arranged between the surrounding wall and the rotational shaft means to maintain a hermetic seal therebetween;

bearing means for rotatable supporting the rotational shaft means on the hermetically sealed tank; and connecting means for transmitting the force from the rotational shaft means to at least one of the contacts to be moved in relation to another of the contacts; and wherein said rotational shaft means is driven through at least two positions of said rotational shaft means of said force generating means, and wherein said bearing means are spaced between said two positions of said rotational shaft means.

2. A gas-filled circuit breaker according to claim 1, wherein both of longitudinal ends of the rotational shaft means are connected to the force generating means at the outside of the surrounding wall.

3. A gas-filled circuit breaker according to claim 1, wherein the bearing means are mounted on the surrounding wall.

4. A gas-filled circuit breaker according to claim 1, wherein the force generating means include link means mounted on the rotational shaft means.

5. A gas-filled circuit breaker according to claim 1, wherein the force generating means comprised a rotary actuator connected to the rotational shaft means.

6. A gas-filled circuit breaker according to claim 1, wherein the gas-filled circuit breaker includes a plurality of the pairs of contacts.

* * * * *